US007350682B2

(12) United States Patent
Meyer

(10) Patent No.: US 7,350,682 B2
(45) **Date of Patent: *Apr. 1, 2008**

(54) RIGID CLIP SUPPORT MEMBER FOR PACKS, BAGS AND OTHER ARTICLES

(75) Inventor: Dean E. Meyer, Oakbrook, IL (US)

(73) Assignee: Meyer Design Group, Inc., Oakbrook, IL (US)

( * ) Notice: Subject to any disclaimer, the term of this patent is extended or adjusted under 35 U.S.C. 154(b) by 358 days.

This patent is subject to a terminal disclaimer.

(21) Appl. No.: 10/767,475

(22) Filed: Jan. 28, 2004

(65) Prior Publication Data

US 2004/0262356 A1 Dec. 30, 2004

Related U.S. Application Data

(63) Continuation-in-part of application No. 10/610,058, filed on Jun. 30, 2003, and a continuation-in-part of application No. 10/706,259, filed on Nov. 12, 2003.

(51) Int. Cl.
*A63B 55/00* (2006.01)
*A45F 3/04* (2006.01)

(52) U.S. Cl. ..... 224/628; 224/637; 224/262

(58) Field of Classification Search ..... 224/262, 224/625, 628, 630, 634, 637, 640, 641, 662, 224/664, 665, 671, 677; 206/315.3; 248/96
See application file for complete search history.

(56) References Cited

U.S. PATENT DOCUMENTS 1,448,918 A * 3/1923 Drager ..... 224/261
2,820,498 A * 1/1958 Endee ..... 224/608
3,581,961 A * 6/1971 Owens ..... 224/262
4,054,256 A * 10/1977 Buck et al. ..... 248/96
4,099,657 A * 7/1978 Zufich ..... 224/262
4,154,381 A * 5/1979 Zufich ..... 224/262
4,214,685 A * 7/1980 Pletz ..... 224/634
4,298,149 A * 11/1981 Gottschalk et al. ..... 224/201
4,303,186 A * 12/1981 Ollinger, IV ..... 224/634
4,361,259 A 11/1982 Chanter
4,479,595 A 10/1984 Opsal
4,676,418 A * 6/1987 Lowe ..... 224/638
4,685,601 A 8/1987 Riddling
4,782,535 A * 11/1988 Yewer et al. ..... 2/321
4,892,238 A * 1/1990 Pinczowski ..... 223/92
5,348,205 A * 9/1994 Steurer ..... 224/627

(Continued)

*Primary Examiner*—Nathan J. Newhouse
*Assistant Examiner*—Justin M. Larson

(57) ABSTRACT

A rigid, flexible weight support clip for over-the-back mounted packs, bags, and other articles. In one embodiment, the clip is located within the interior of a back pack and includes arms adapted to protrude through apertures defined in the pack and extend through respective exterior sleeves. The clip may be made of a shape memory alloy or bent in a manner which allows the arms to flex either towards or away from each other and to exert a compressive force against the waist, hips and/or back of the user. In another embodiment, the clip is adapted to be suspended from the handle of a golf club adapted to be carried in a generally horizontal orientation and the clip is pivotable about the handle into engagement with the waist and/or hips of the user. In another embodiment, the clip is adapted to extend from and pivot about the front face of a golf bag adapted to be carried in a generally vertical orientation.

6 Claims, 12 Drawing Sheets

U.S. PATENT DOCUMENTS 5,351,921 A * 10/1994 Chen ..... 248/96
5,419,473 A * 5/1995 Lamar ..... 224/632
5,429,287 A * 7/1995 Frano ..... 224/640
5,487,498 A 1/1996 Gleason
5,820,141 A 10/1998 Wilkerson et al.
5,836,489 A * 11/1998 Swetish ..... 224/262
5,890,640 A * 4/1999 Thompson ..... 224/630
5,984,157 A * 11/1999 Swetish ..... 224/631
5,996,871 A 12/1999 Maeng
6,006,974 A * 12/1999 Varney et al. ..... 224/645
6,024,265 A * 2/2000 Clements ..... 224/630
6,182,874 B1 2/2001 Feldman, Jr.
6,199,732 B1 * 3/2001 Swetish ..... 224/262
6,276,584 B1 * 8/2001 McLachlan ..... 224/637
6,607,108 B2 * 8/2003 Mydans ..... 224/630
6,840,419 B2 * 1/2005 Penny et al. ..... 224/637
6,886,727 B2 * 5/2005 Moore ..... 224/637

* cited by examiner

Fig.1
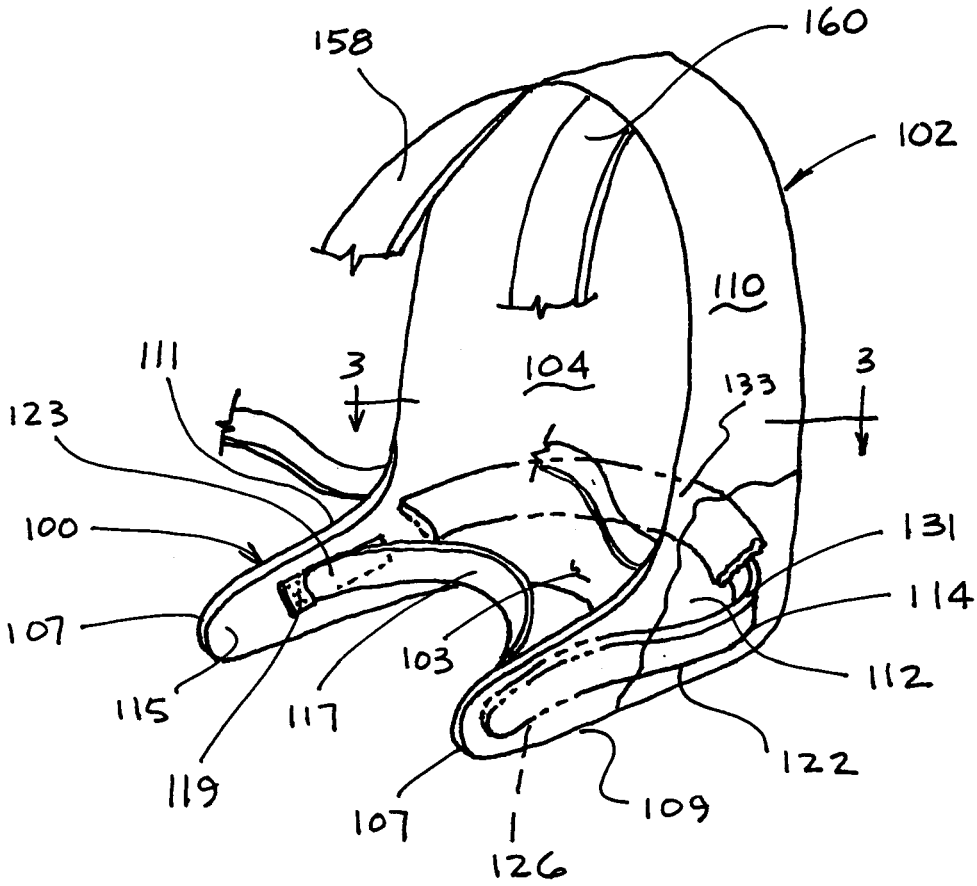
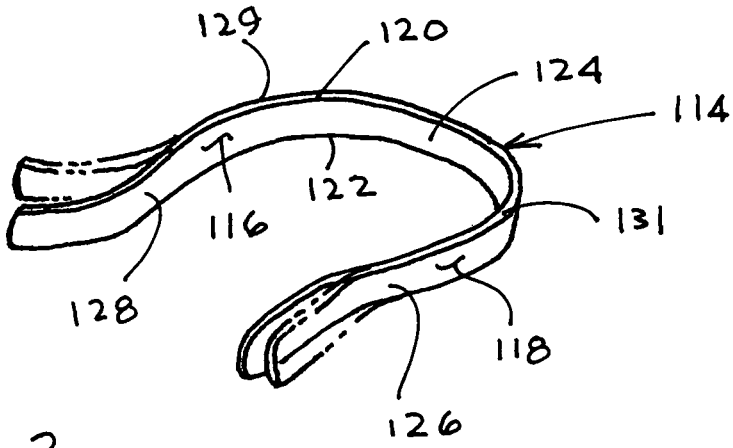
Fig.2

Fig. 7A
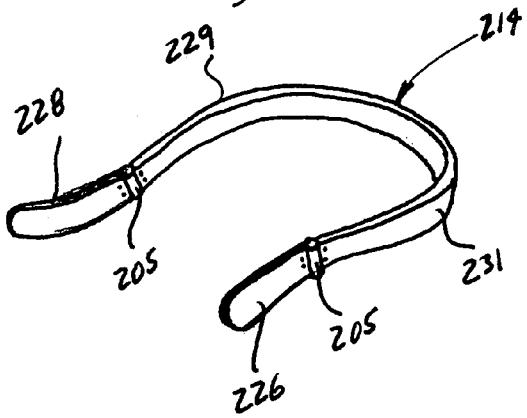
Fig. 7B
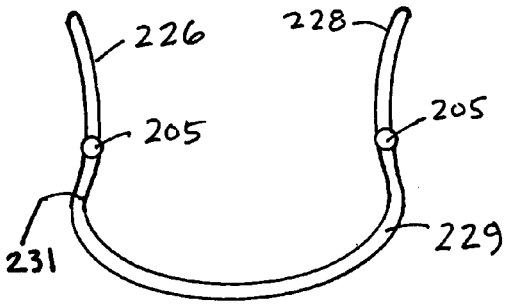
Fig. 7C
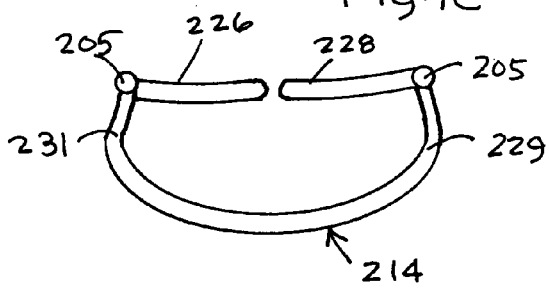
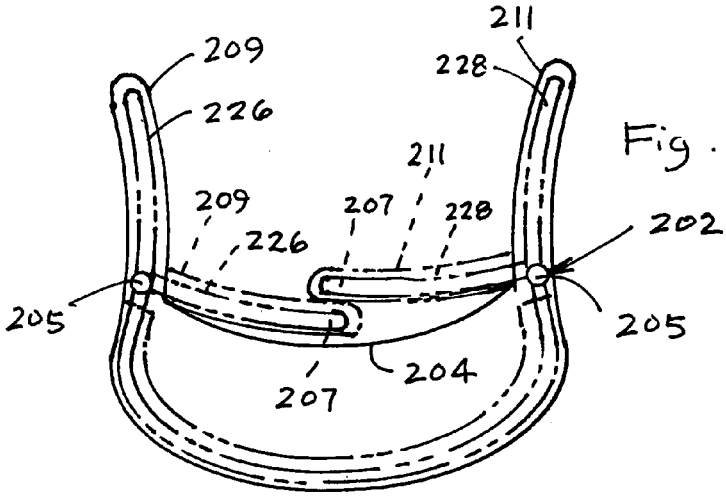
Fig. 8

Fig. 13
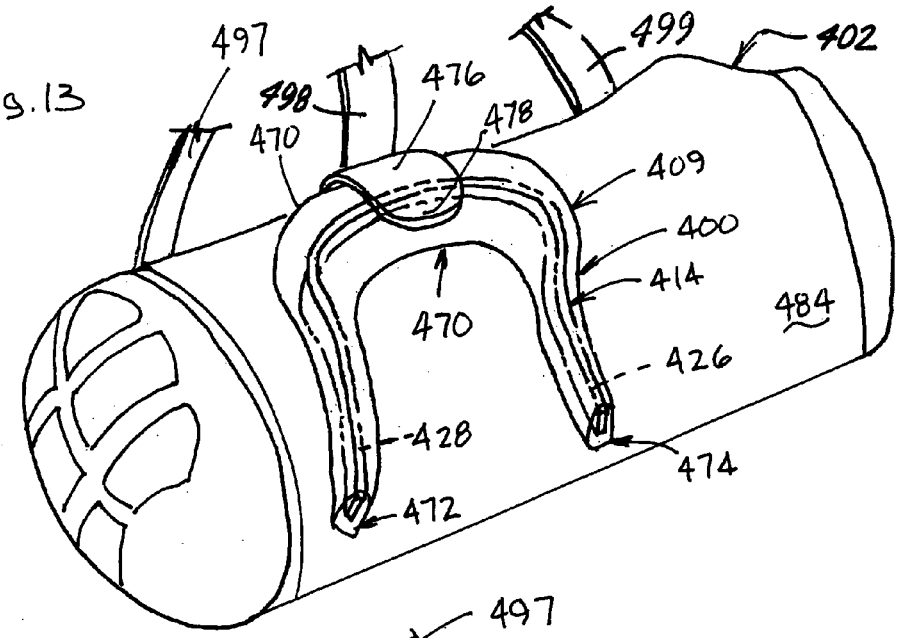
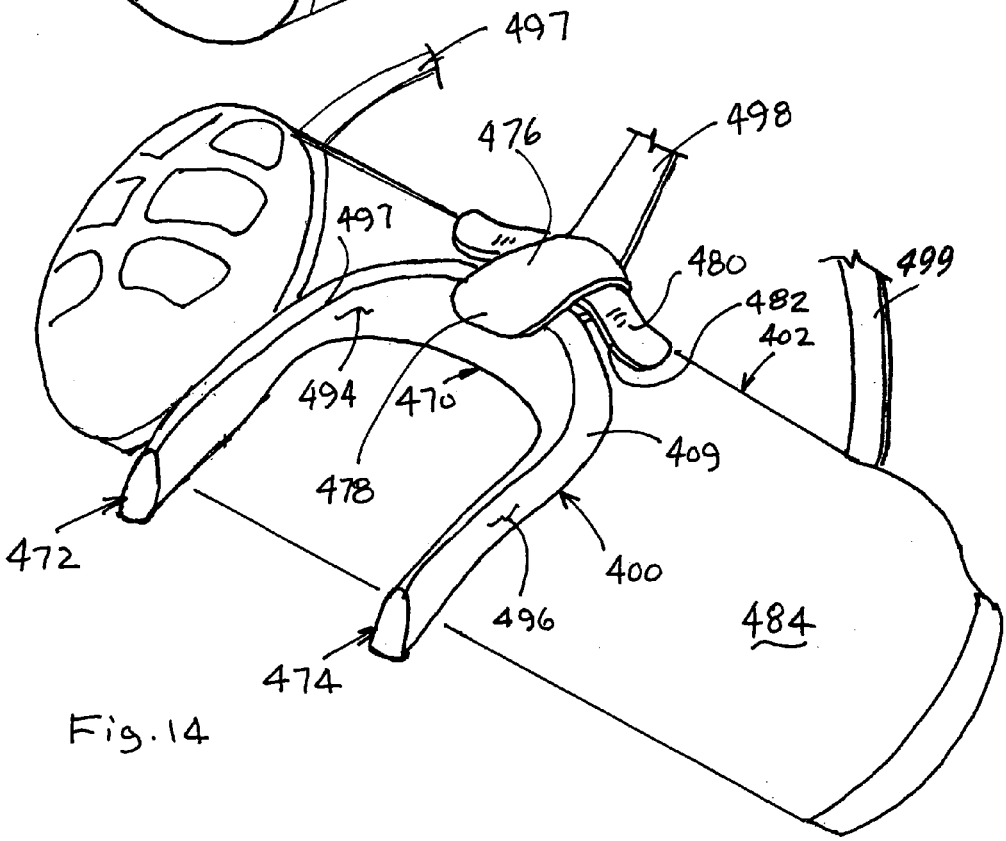
Fig. 14

RIGID CLIP SUPPORT MEMBER FOR PACKS, BAGS AND OTHER ARTICLES

RELATED APPLICATIONS

This application is a continuation-in-part application of U.S. patent application Ser. No. 10/610,058 filed on Jun. 30, 2003 and U.S. patent application Ser. No. 10/706,259 filed on Nov. 12, 2003, both of which are incorporated herein by reference.

FIELD OF THE INVENTION

This invention relates generally to packs, bags and other articles adapted to be suspended and carried in an over-the-back relationship and, more particularly, to a rigid clip member for supporting such packs, bags and other articles.

BACKGROUND OF THE INVENTION

Packs, bags and other articles which are suspended from the shoulders and mounted to the back of a wearer such as, for example, school back packs, hiking back packs, and golf bags have been in widespread use for many years. Although these articles have proven effective in allowing wearers to carry and support such articles as, for example, books, hiking supplies and golf clubs, they disadvantageously have placed wearers at an increased risk of shoulder and back injury due to the considerable weight which is often times carried in these articles. This risk has become a particular concern for grade school children who are increasingly being forced to carry excessive numbers of books and supplies in their back packs in order to keep up with the ever escalating homework requirements. This risk is also a concern for caddies who must carry golf bags weighing more than fifty pounds for more than 7,000 yards during a four hour round of play.

In the past, adjustable flexible belts or harnesses adapted to be wrapped and tied around the waist of a wearer have been used in an attempt to relieve the weight of the pack, bag or other article. These belts and harnesses, however, have been ineffective as a weight transferring device and there thus remains a need for a rigid clip support member, and for packs, bags or other articles incorporating the same, which will effectively transfer the weight from the shoulders and back of the wearer to the waist, hips and/or lower back of the wearer.

SUMMARY OF THE INVENTION

The present invention relates to a clip adapted for use in connection with a pack, bag or other article intended to be carried by a user in an over-the-back relationship where the clip defines a pair of rigid spaced-apart arms adapted to rest or engage against the waist, hips or back of the user.

In one embodiment, the pack, bag or article defines a shell and an interior and the clip is adapted to be located within the interior of the article in a relationship wherein the arms thereof protrude through openings defined in the shell of the pack, bag or article. The pack, bag or article additionally may define a pair of sleeves extending outwardly from the openings defined in the shell and the arms of the clip are adapted to extend through the sleeves. The arms may be made from a shape memory alloy or bent in a manner which allows the arms to flex laterally away from each other to adjust the width of the clip and the arms are further adapted to spring back towards each other and exert a compressive force against the waist and/or hips of the user.

In another embodiment, the bag is a golf bag including a handle and an outer surface and the support member defines a clip suspended from the handle of the golf bag. The clip is pivotable about the handle of the golf bag between a first position wherein the arms are positioned adjacent the outer surface of the bag and a second position wherein the clip and the arms thereof have been rotated away from the outer surface into engagement with the waist and/or hips of the user.

In still another embodiment, the clip is associated with the front face of a golf bag and is pivotable therefrom between a first position wherein the arms thereof are positioned generally parallel to the front face and a second position wherein the arms are positioned generally normal to the front face and adapted to engage the waist and/or hips of the user.

In accordance with the present invention, the use and incorporation of the waist and hip engaging clip of the present invention into over-the-back mounted packs, bags and other articles reduces the shoulder and upper back stresses and injuries which users of these packs, bags and other articles have experienced by advantageously reconcentrating and redistributing the weight which is normally supported entirely by the shoulders and upper back of the wearer to the waist and hips of the wearer.

Other advantages and features of the present invention will be more readily apparent from the following detailed description of the preferred embodiments of the invention, the accompanying drawings, and the appended claims.

BRIEF DESCRIPTION OF THE DRAWINGS

In the drawings:

FIG. 1 is a perspective view, partially in phantom and broken away, of a back pack incorporating a waist clip support member of the present invention;

FIG. 2 is a perspective view of the waist clip support member of the present invention;

FIG. 7A-C depict respective perspective and plan views of an alternate foldable embodiment of the rigid waist clip support member of the present invention;

FIG. 8 is a horizontal cross-sectional view, similar to FIG. 3, of a back pack incorporating the foldable rigid clip support member of FIGS. 7A-C;

FIG. 13 is a side perspective view, partially broken away, of a golf bag incorporating an alternate embodiment of the waist clip support member of the present invention;

FIG. 14 is a side perspective view, partially broken away, of the golf bag of FIG. 13 with the waist clip support member in its rotated, engageable position;

DETAILED DESCRIPTION OF THE PREFERRED EMBODIMENTS

Figure 3:
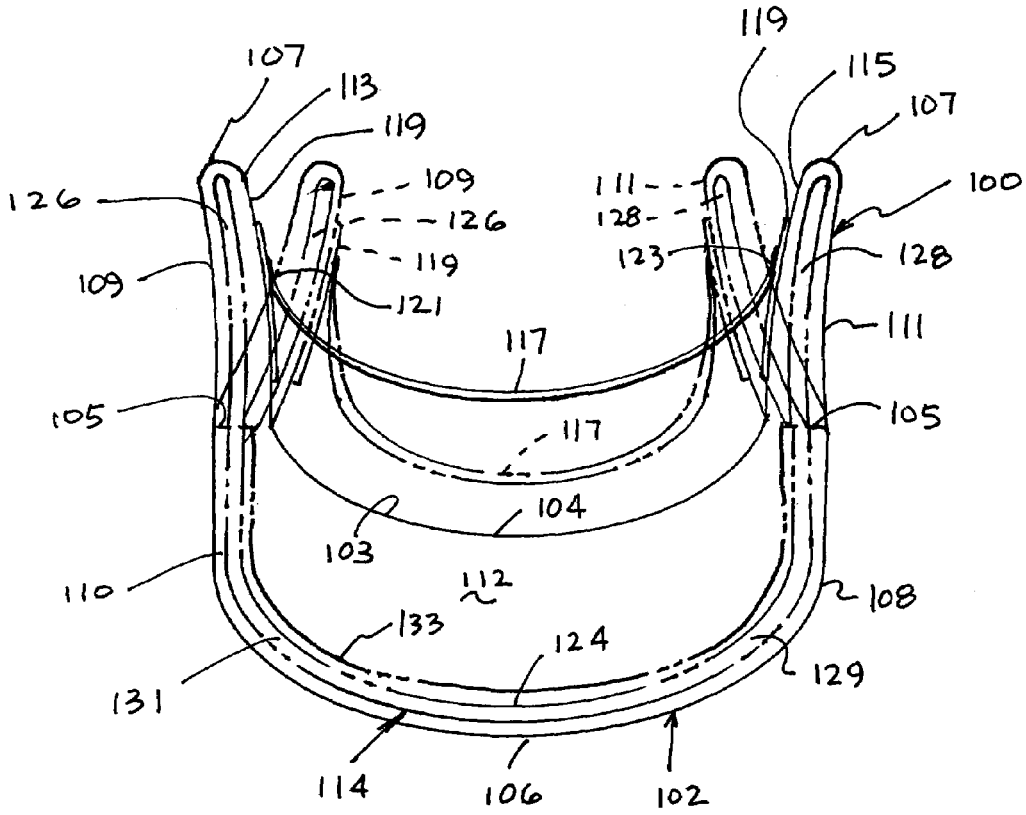
FIG. 3 is a horizontal cross-sectional view, partly in phantom, of the back pack taken along the plane 3-3 in FIG. 1.

The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

For ease of description, the waist and back clip support members and the various articles of the present invention adapted to incorporate the same will be described in a normal (upright) operating position and terms such as upper, lower, horizontal, etc., will be used with reference to this position. It will be understood, however, that the support member and the various bags and articles of the present invention may be manufactured, stored, transported, used, and sold in an orientation other than the positions shown and described herein.

FIGS. 1-3 depict a waist clip support member 100 which, in the embodiment shown, is adapted for use with any type of over-the-back shoulder mounted bag, pack or article such as, for example, the back pack 102 shown in FIGS. 1 and 3 which includes opposed, spaced front and back panels or faces 104 and 106 respectively, opposed and spaced side panels or faces 108 and 110 respectively and a bottom face or panel 112, all together unitarily joined to define a shell defining a hollow interior for carrying and storing books, supplies or the like materials. A lower longitudinal strip 103 of the front panel 104 extending between the side panels 108 and 110 is generally arcuately, concavely shaped so as to correspond generally to the curvature of the small of the back of the wearer of the pack 102 for the purposes to be described in more detail below. Back pack 102 and, more particularly, the panels thereof, may be made from any suitable durable and pliable material including, for example, fabric, vinyl, leather or the like.

Waist clip support member 100 initially comprises a pair of elongate, hollow spaced-apart sleeves 109 and 111 extending generally unitarily normally outwardly from the opposed lower corners of the front panel 104 generally adjacent the bottom panel 112 and the front longitudinal vertical edges of the respective side panels 108 and 110. Sleeves 109 and 111 include open proximal ends defining a pair of respective spaced-apart apertures 105 in the panel 104 in communication with the interior of the pack 102 and respective closed distal ends 107 spaced from the open proximal ends and the front panel 104. In the embodiment of FIGS. 1 and 3, sleeves 109 and 111 are disposed in a generally horizontal, spaced-apart, co-planar relationship. It is understood that sleeves 109 and 111 may be made unitary with and from the same type of material as the panels of pack 102 or separately and from any other type of material suitable for providing a padded or cushioned surface. For example, and although not shown, it is understood that the interior inner facing faces 113 and 115 of the sleeves 109 and 111 respectively may include thickened, foam-like comfort, protective or cushioning pads associated therewith and made from any suitable soft, pliable or deformable cushioning material for the purposes to be described in more detail below.

As shown in FIGS. 1 and 3, an elongate strap 117 extends generally horizontally between and interconnects the sleeves 109 and 111 respectively. A strip 119 of Velcro® hook and loop type or the like material is secured to the inner face of each of the respective sleeves 109 and 111. Strips 119 are adapted to cooperate with like strips (not shown) of Velcro® hook and loop or the like type material associated with the respective ends 121 and 123 of the strap 117 so as to allow the strap 117 to be removably and adjustably secured to the sleeves 109 and 111.

Waist clip support member 100 additionally comprises a clip 114 in the form of an elongate, generally rectangularly shaped bar which may be made of aluminum, steel, plastic, composite or the like suitable rigid and resilient material which has been bent generally in the shape of a "U" or "horseshoe". Clip 114 which, in the embodiment shown, is generally rectangular in vertical cross-section and includes inner and outer vertical side surfaces 116 and 118 respectively and upper and lower horizontal surfaces 120 and 122 respectively, defines a central, generally arcuately shaped base or body portion or segment 124 and a pair of spaced-apart waist and/or hip engaging clip arms 126 and 128 extending generally horizontally co-planarly outwardly from respective opposed curved shoulders 129 and 131 of the body 124 in a relationship wherein the inner surfaces 116 of the respective arms 126 and 128 face each other and extend in a generally vertical orientation.

Although not shown in any of the drawings, it is understood that the clip 114 may also take the form of a round, elongate shaft or any other form suitable for providing the functions and intended uses described below in more detail including the shape and form of the clip support member embodiment depicted in FIGS. 21 and 22.

In accordance with the present invention, clip 114 is adapted to be located and secured within the interior of the pack 102 as shown in FIG. 1 in a relationship wherein the base or body 124, shoulders 129 and 131 and arms 126 and 128 thereof follow the contour of the interior faces of the back and side panels 106, 108 and 110 respectively of the pack 102. Particularly, clip member 114 is located within the interior of the pack 102 in a relationship wherein the lower horizontal surface 122 thereof is adapted to be seated against or positioned adjacent the inner horizontal surface of the bottom panel 112 of the pack 102, the outer vertical surface 118 of the clip 114 (in the region of the base 124 thereof) is disposed generally adjacent and parallel to the inner vertical face of the back panel 106 of the pack 112, and the arms 126 and 128 of the clip 114 extend generally longitudinally and horizontally forwardly in the direction of the front panel 104 in a relationship generally adjacent and parallel to the inner faces of the respective side panels 108 and 110 of the pack 102. The arms 126 and 128 then protrude through the respective opposed apertures 105 and extend through the length of the interior of the sleeves 109 and 111 respectively.

An elongate cover strip 133, located within the interior of the pack 102, is adapted to cover at least the base and shoulders respectively of the clip 114. Strip 133 may be stitched or otherwise suitably secured to the interior faces of the front and bottom panels 106 and 112 respectively of the pack 102.

Figure 5:
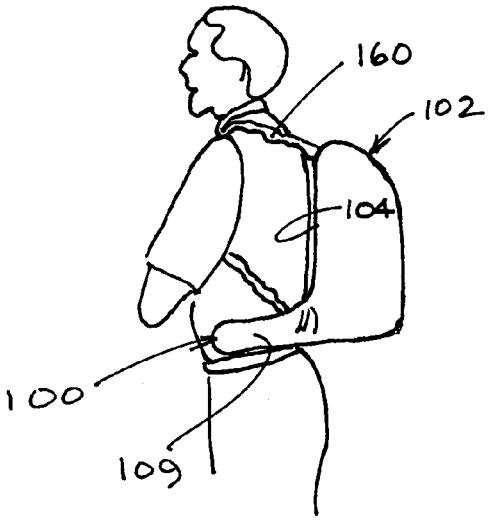
FIG. 5 is a side elevational view of the back pack of FIG. 1 suspended from the shoulders of the wearer with the arms of the waist clip support member engaged against the waist and hips of the wearer.
Figure 6:
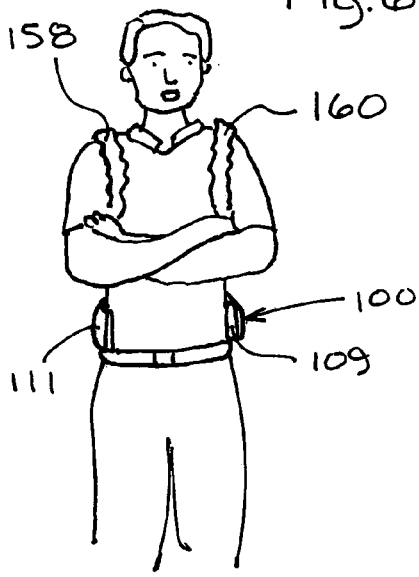
FIG. 6 is a front elevational view of the back pack of FIG. 1 suspended from the shoulders of the wearer with the arms of the waist clip support member engaged against the waist and hips of the wearer.
Figure 9:
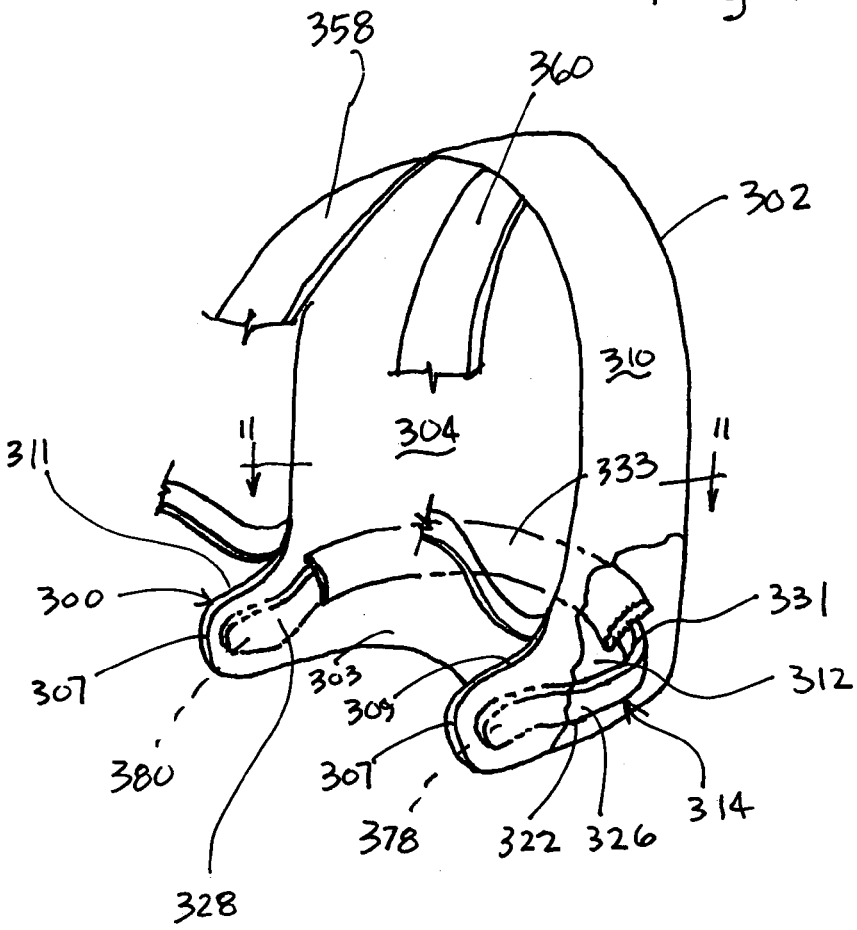
FIG. 9 is a perspective view, partially in phantom and broken away, of a back pack incorporating an alternate rigid back clip support member of the present invention.

As shown in FIGS. 5 and 6, back pack 102 is adapted to be suspended from the shoulders of a wearer by means of shoulder straps 158 and 160 and carried in an over-the-back relationship wherein the front panel 104 of the pack 102 is disposed adjacent the wearer's back and the lower longitudinal strip 103 thereof is disposed against, and follows the contour of, the small of the wearer's back, and the sleeves 109 and 111, and thus the arms 126 and 128 of clip 114, are positioned in an abutting engaged relationship against the respective sides of the waist and/or hips of the individual carrying the pack 102. Thus, and as shown in FIGS. 5 and 6, the sleeves 109 and 111 in combination with the strip 103 define a generally "U" shaped ring which is open at the front thereof to receive and engage with the lower torso of the individual as described above. Moreover, and although not shown in any of the drawings, it is understood that, to provide additional support and comfort, strip 103 could likewise incorporate an elongate piece of reinforcing material similar to clip 114 and extending between the open proximal ends of the sleeves 109 and 111.

Figure 4:
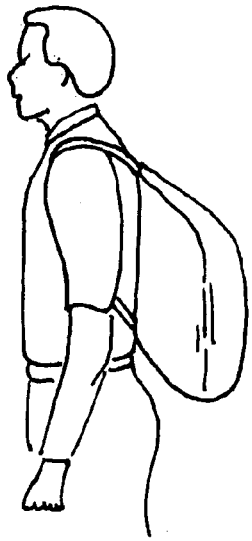
FIG. 4 is a side elevational view of a prior art back pack suspended from the shoulders of a wearer.

As is well known in the art as shown in FIG. 4, the weight of the contents of today's back packs is supported entirely by the pack's shoulder straps which, of course, causes all of the weight of the contents of the pack to be suspended from and concentrated in the shoulders and upper back of the user. Moreover, the structure of today's packs causes all of the weight of the contents to be located in the bottom of the pack which, of course, causes today's packs to sag as also shown in FIG. 4.

This, of course, places an undue amount of stress on the shoulders and the upper back of the individual carrying the pack and often results in injuries thereto particularly where the weight of the items carried in the bag is disproportionate to the strength of the shoulders and/or upper back of the user such as, for example, where children are forced to carry and support heavy school books or, as another example, where military personnel are required to carry and support heavy supplies.

It is also known that the waist and/or hips of a person are better suited than the shoulders and/or upper back of a person from a physical, structural and location standpoint for supporting and/or carrying the weight of a back pack. The present invention advantageously recognizes the increased strength of the waist and/or hips of an individual and causes the weight of the pack 102, and the contents stored in the interior thereof, to be transferred and redistributed successively through the shoulder straps 158 and 160 (as evidenced by the slack in the shoulder straps 158 and 160 in FIGS. 5 and 6), the shell of the pack 102, the clip 114 and, more particularly, the arms 126 and 128 thereof, and then to the waist and/or hips of the wearer.

This, of course, advantageously reduces the shoulder and upper back stresses and injuries which users of standard back packs have experienced. According to the invention, a majority of the weight of the back pack 102 and its contents is thus advantageously reconcentrated and redistributed through the waist clip support member 100 from the shoulders and upper back of the wearer to the hips and/or waist and lower back of the wearer. The presence of the clip 114 in the interior of the pack 102 and, more particularly, the positioning thereof along the periphery of the bottom panel 112 thereof also advantageously defines a reinforcing and structural bar which provides rigidity to the bottom panel 112 of the pack 102, thus eliminating sagging of the pack 102.

In accordance with the present invention, clip 114 may be made from any suitable shape memory alloy or the like material and/or shaped or bent in a manner which allows the sleeves 109 and 111 and thus arms 126 and 128 of clip 114 thereof to flex laterally outwardly away from each other as shown in phantom in FIG. 2 thus allowing the clip 114 to expand to accommodate differently sized waists and/or hips. It is understood, of course, that once the clip 114 has been expanded and the arms 126 and 128 are engaged against the waist and/or hips of the user as shown in FIGS. 5 and 6, the arms 126 and 128 will, as a result of their shape memory or bent construction, tend to flex or contract back towards each other thus resulting in the application of an engagement or compressive spring action or force against the waist and/or hips of the user which further enhances the weight transfer and support characteristics of the clip support member 100 of the present invention.

Moreover, and as shown in FIG. 3 and described below, it is understood that the strap 117, by virtue of the positioning and securement thereof between the sleeves 109 and 111, is adapted to cause the sleeves 109 and 111 (and thus the clip arms 126 and 128 therein) to flex laterally inwardly towards each other when a user mounts the pack 102 over his/her back. Stated another way, the mounting of the pack 102 causes the strap 117 to come into abutting relationship with the small of the user's back which, in turn, forces the strap 117 to move rearwardly in the direction of the front panel 104 thereof which, in turn, causes the sleeves 109 and 111 and the arms 126 and 128 to flex inwardly into compressive engaging action against the waist and/or hips of the wearer so as to still further enhance the weight transfer and support features of the clip member 100 of the present invention.

Although not specifically shown in any of the drawings, it is also understood that the releasable feature of strap 117 allows a user to manually vary the distance between the strap 117 and the pack 102 which, in turn, allows a user to customize the compressive action created by the sleeves 109 and 111 when strap 117 forces said sleeves 109 and 111 together. This compressive action, of course, allows the clip 114 to be firmly and tightly engaged against the waist and/or hips of the user which, in turn, allows the pack 102 to be firmly and tightly suspended and carried. The compressive action additionally provides for a more efficient transfer of the weight of the contents of the pack 102 from the arms 126 and 128 to the waist and/or hips of the user.

FIGS. 7(A-C) and 8 depict an alternate clip embodiment 214 structurally and functionally similar in all respects to the clip 114 (which earlier description is thus incorporated herein by reference) except that the arms 226 and 228 thereof are hingedly or otherwise suitably associated and structured for pivotable movement between a first position as shown in FIG. 8 where the arms 226 and 228 (and thus the sleeves 209 and 211 of pack 202 as shown in FIG. 8) are disposed in a generally parallel, horizontally co-planar relationship relative to each other and a generally normal relationship relative to the front of the pack 202 and a second position as shown in FIGS. 7C and 8 (in phantom) where the arms 226 and 228 (and thus the sleeves 209 and 211) have been folded and pivoted inwardly towards each other into a collapsed horizontal co-planar relationship where the arms 226 and 228 and thus the sleeves 209 and 211 are positioned in a generally adjacent and parallel nesting relationship adjacent the front panel 204 of the pack 202 with the distal end 207 of sleeve 211 overlapping and abutted against the distal end 207 of sleeve 209. In the embodiment of FIGS. 7(A-C), a hinge 205, located on clip 114 between the respective shoulders and arms thereof defines the means which allows the arms 226 and 228 to pivot about the respective shoulder portions 229 and 231 thereof.

The collapsible clip support member embodiment of FIGS. 7 and 8, of course, advantageously allows the overall size of the pack 202 to be reduced which, of course, allows the pack 202 to be more easily transported when not in use and also allows the pack 202 to be more easily stored in lockers, closets and the like.

Figure 12:
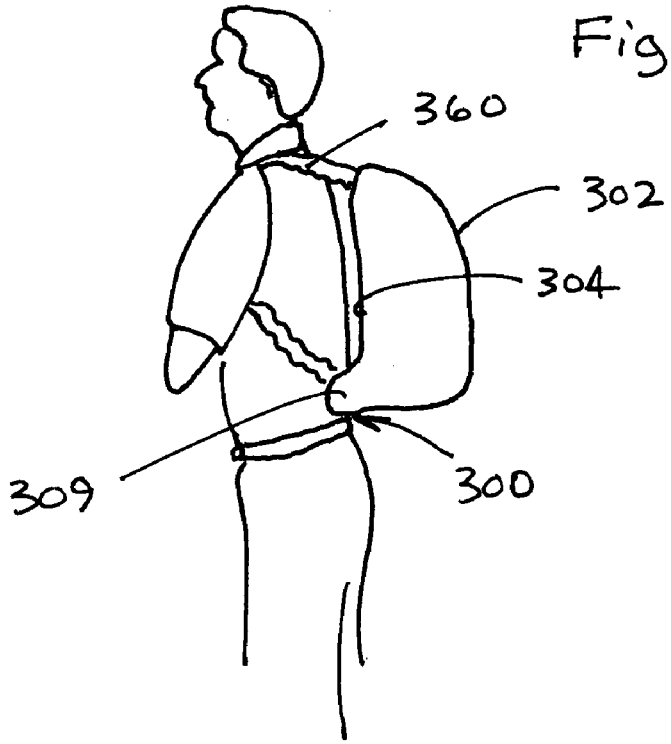
FIG. 12 is a side elevational view of the back pack of FIG. 9 suspended from the shoulders of a wearer.

FIGS. 9-12 depict a back pack embodiment 302 incorporating a back clip support member 300 which differs from the waist clip support member 100 in that member 300 is structured, shaped and sized to allow the distal back engaging hands 378 and 380 of the arms 326 and 328 respectively of the clip 314 comprising the member 300 to rest against the small of the back of a wearer as shown in FIG. 12 instead of engagement against the waist and/or hips of the wearer as with the waist clip support member 100.

Pack 302 is similar in structure to the pack 102 in that pack 302 includes opposed and spaced front and back panels or faces 304 and 306 respectively, opposed and spaced side panels or faces 308 and 310 respectively and a bottom panel or face 312, all together unitarily joined to define an outer shell defining a hollow storage interior. Back pack 302 additionally defines a pair of elongate, hollow spaced-apart sleeves 309 and 311 extending generally unitarily normally outwardly from the opposed lower corners of the front panel 304 along the front longitudinal vertical edge of the side panels 308 and 310 respectively. Sleeves 309 and 311, which are less than about half the length of the sleeves 109 and 111 of the pack 102, include open proximal ends which define a pair of respective, spaced-apart apertures 305 in the front panel 304 in communication with the interior of the pack 302 and respective closed distal ends 307 spaced from the respective apertures 305 and the front panel 304. Sleeves 309 and 311 may be constructed in the same manner as, and from the same materials as, the sleeves 109 and 111.

Moreover, and in a manner similar to the pack 102, front panel 304 of pack 302 includes a lower longitudinal, generally arcuately and concavely shaped back engaging strip 303 extending between the side panels 308 and 310 and sleeves 309 and 311 and corresponding generally in curvature and shape to the curvature of the small of the back of the wearer of the pack 302.

Clip 314 is similar in structure and shape to clip 114 in that clip 314 also defines an elongate, generally rectangularly shaped flat bar made from the same type of material as clip 114 and which has been bent into a generally "U" or "horseshoe" shape. Clip 314, which is generally rectangularly shaped in vertical cross-section and includes inner and outer flat vertical surfaces 316 and 318 and upper and lower horizontal surfaces 320 and 322 respectively, defines a central, generally arcuately shaped base or body portion or segment 324 and a pair of spaced-apart, parallel arms 326 and 328 respectively extending generally horizontally co-planarly outwardly from respective opposed shoulders 329 and 331 unitary with the ends of the body 324 respectively. Arms 326 and 328 are shorter than the arms 126 and 128 of clip 114 and are characterized in that the distal end portions thereof are bent or curved so as to define hands 378 and 380 adapted to engage and rest against the small of the back of a wearer as shown in FIG. 12.

In accordance with the present invention, and in a manner similar to waist clip support member 100, back clip support member 300 is adapted to be located and secured within the interior of the pack 302 in a relationship wherein clip 314 is located generally adjacent to or seated against the bottom pack panel 112 and the respective base, shoulder and arm portions thereof generally follow the contour of the interior faces of the back and side panels 306, 308 and 310 respectively of the pack 302.

Particularly, clip 314 is located and positioned in the interior of the pack 302 in a relationship where the lower horizontal surface 322 of clip 314 is positioned generally adjacent or seated against the bottom panel 312, the outer vertical surface 318 of bar 314 (in the region of the arcuate base 324 thereof) is disposed generally adjacent and parallel to the inner vertical surface of back panel 306, and the arms 326 and 328 extend generally horizontally forwardly in the direction of the front panel 304 in a relationship generally adjacent and parallel to the inner vertical surfaces of the respective pack side panels 308 and 310. Hands 378 and 380 protrude through the respective apertures 305 in the front panel 304 and into and through the hollow interior defined by the sleeves 309 and 311 respectively. An elongate cover 333, similar in structure and function to the cover 133, is located within the interior of the pack 302 and adapted to overlay and cover at least the body and shoulders of the clip 314.

As shown in FIG. 12, back pack 302 is adapted to be suspended from the shoulders of the wearer by means of shoulder straps 358 and 360 in an over-the-back relationship wherein the front panel 304 of the pack 302 is disposed adjacent the back of the wearer, the lower longitudinal arcuate strip 303 and sleeves 309 and 311 of the pack 302 are disposed against and follow the contour of the small of the back of the wearer, and the hands 378 and 380 in the interior of sleeves 309 and 311 are positioned against with the respective opposed sides of the small of the back of the individual carrying the pack.

Figure 10:
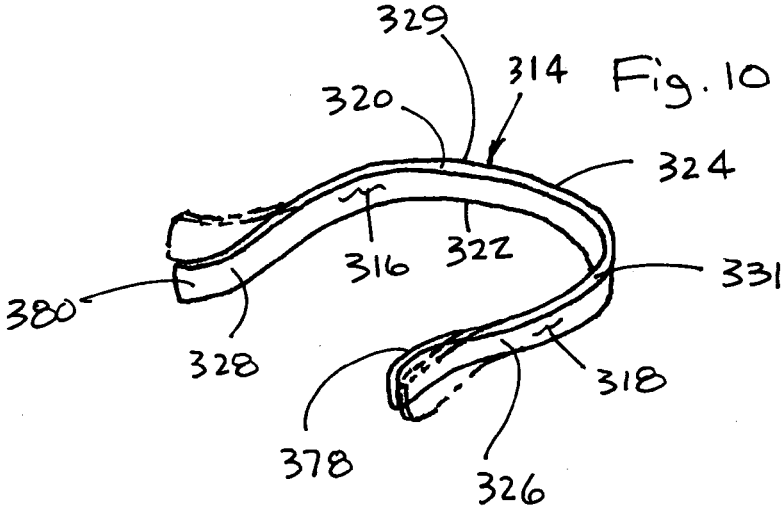
FIG. 10 is a perspective view of the back clip support member of the back pack of FIG. 9.
Figure 11:
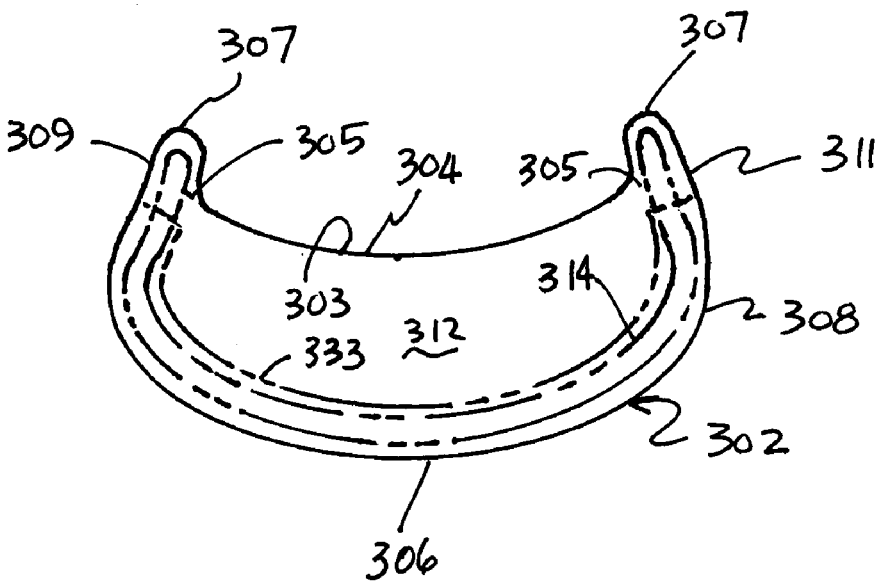
FIG. 11 is a horizontal cross-sectional view, partially in phantom, of the back pack taken along the plane 11-11 in FIG. 9.

In accordance with the present invention and, in a manner similar to the clip 114 of pack 102 and thus incorporated herein by reference, clip 314 may be made of a material (such as a suitable shape memory alloy) and/or shaped and/or bent in a manner which advantageously allows the sleeves 309 and 311 and thus the arms 326 and 328 to bend, flex or stretch laterally and outwardly away from each other as shown in phantom in FIG. 10 to allow the clip 314 and, more particularly, the hands 378 and 380 thereof to conform to the curve, shape or configuration of the small of the back of any wearer thus providing a comfortable, custom fitting pack 302.

Moreover, and in a manner similar to the clip 114 and thus incorporated herein by reference, clip 314 and, more particularly, the arms 326 and 328 thereof, offer the added advantage of defining a weight redistribution member, i.e., a member allowing the transfer and redistribution of the weight of the pack and the contents thereof from the straps 358 and 360 and the shoulders of the wearer to the back clip 314 and thus the small of the back of the wearer as shown in FIG. 12 in which the shoulder straps 358 and 360 are shown in their "loose" condition.

Figure 15:
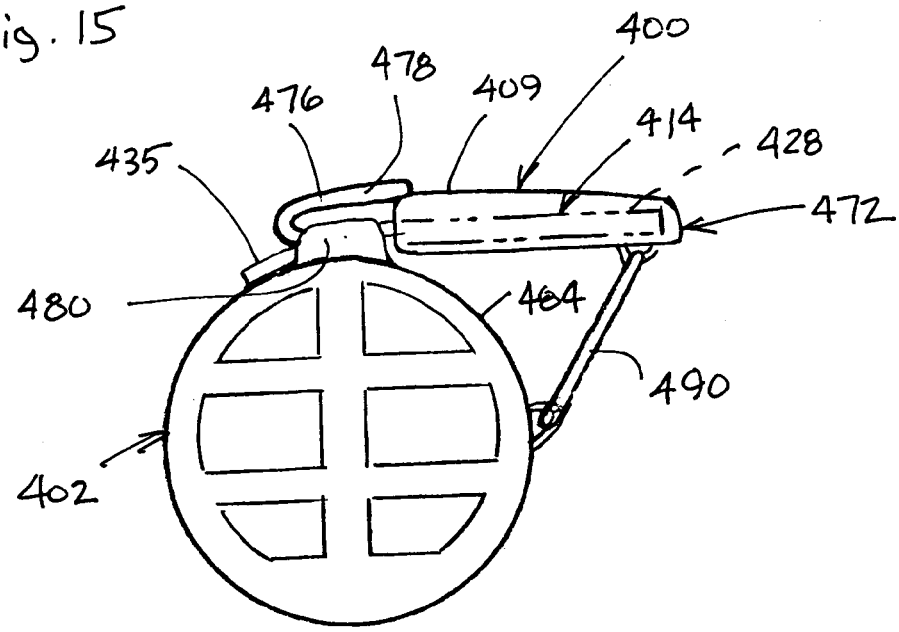
FIG. 15 is a side elevational view, partially broken away, of the golf bag of FIG. 14 depicting the waist clip support member in its engageable position.
Figure 16:
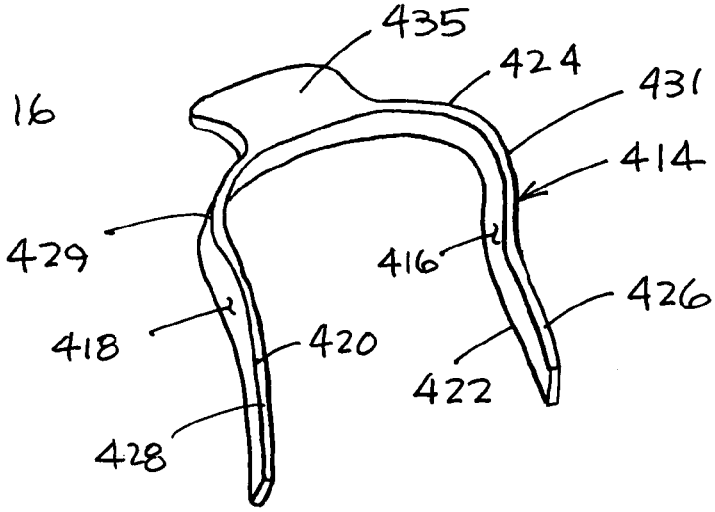
FIG. 16 is a perspective view of the clip of the waist clip support member of FIGS. 14 and 15.
Figure 17:
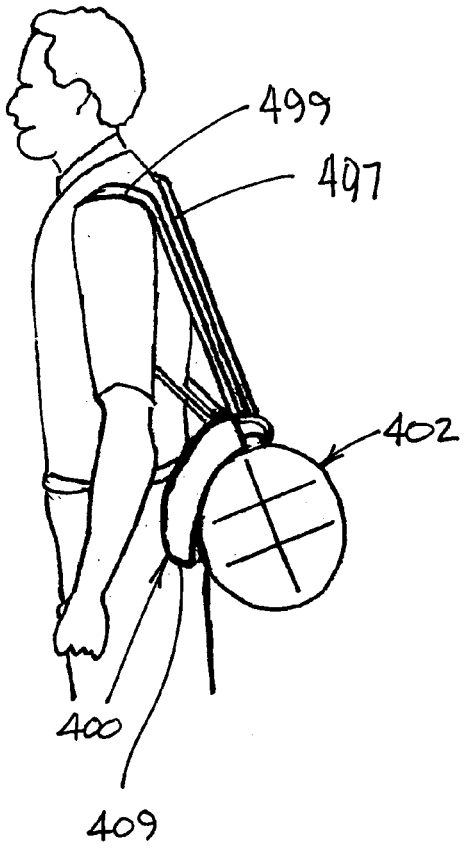
FIGS. 17 and 18 depict the golf bag of FIGS. 13-15 suspended from the shoulders of a golfer in a generally horizontal orientation with the waist clip support member in its disengaged and engaged positions respectively.
Figure 18:
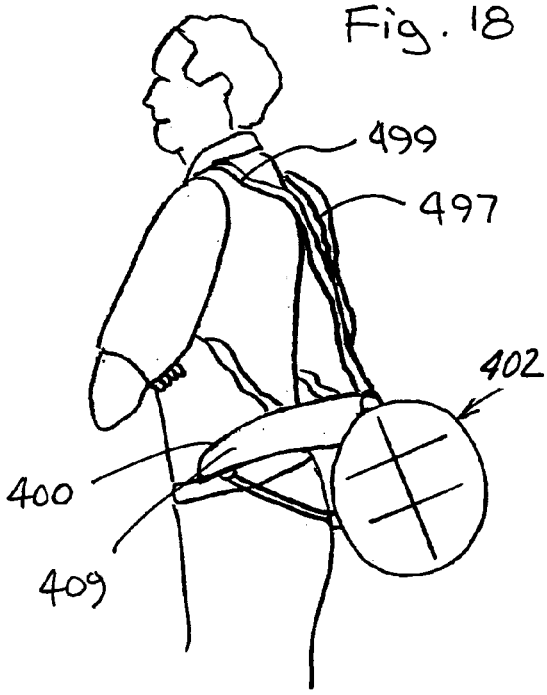

A rigid waist clip support member 400 is shown in FIGS. 13-16 which is adapted to be integrated and used on a golf bag 402 adapted to be suspended from the shoulders of an individual and carried in a generally horizontal over-the-back relationship as shown in FIGS. 17 and 18.

Clip support member 400 incorporates a clip 414 which, as shown in FIG. 16, is similar in structure, shape and function to the clip 114 and thus comprises an elongate, generally rectangularly shaped flat bar which may be made of the same types of materials and bent in the same manner as clip 114 into a generally "U" or "horseshoe" shape. Clip 414 is generally rectangularly shaped in vertical cross-section and thus includes inner and outer vertical side surfaces 416 and 418 respectively and upper and lower horizontal surfaces 420 and 422 respectively. Clip 414 defines a central, generally arcuately shaped base or body segment or portion 424 and a pair of spaced-apart waist and/or hip engaging clip arms 426 and 428 extending generally horizontally co-planarly outwardly from the respective opposed arcuate shoulders 429 and 431 of body 424 in a relationship wherein the inner surfaces 416 of the respective arms 426 and 428 face each other and extend in a generally vertical orientation.

Figure 22:
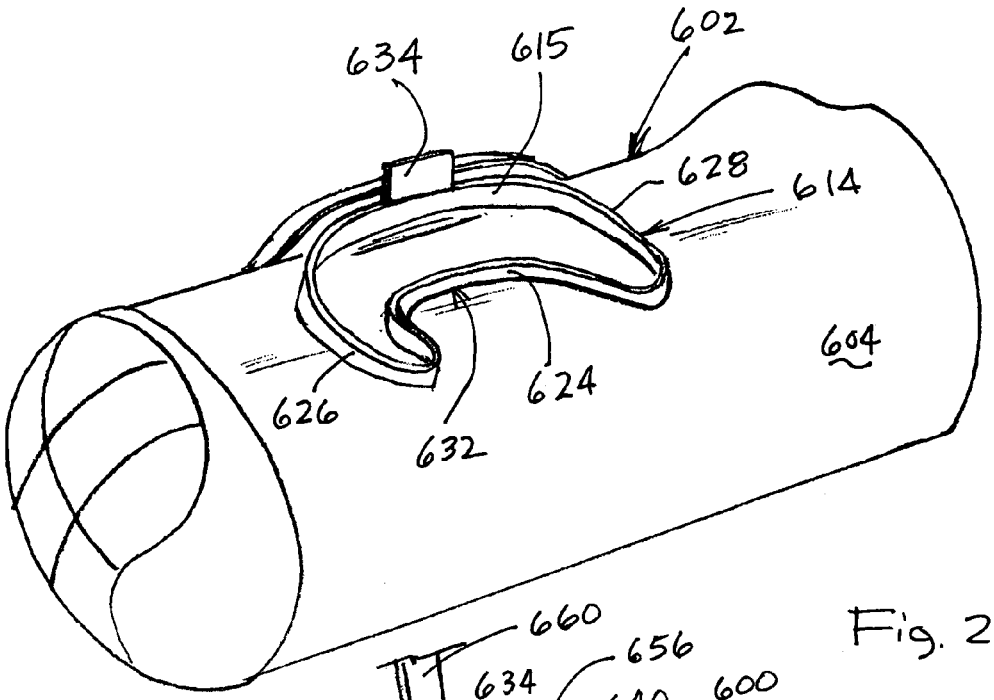
FIG. 22 is a perspective view similar to FIG. 21 with the cushion sleeve of the support member removed therefrom to reveal the clip therein.
Figure 21:
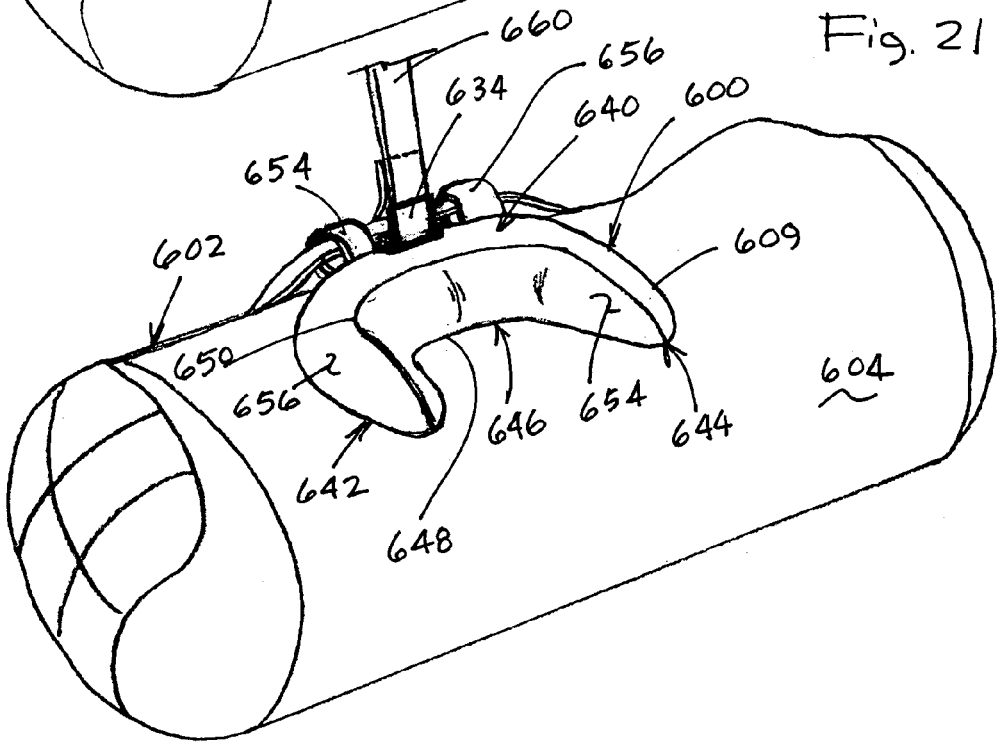
FIG. 21 is a partially broken, perspective view of a golf bag incorporating an alternate embodiment of a clip support member in accordance with the present invention.

As with clip 114, it is understood that clip 414 can take the form of a round shaft or any other suitable configuration or shape as desired including, for example, the configuration and shape of the clip support member embodiment shown in FIGS. 21 and 22.

Moreover, and although not shown, it is understood that clip 414 may likewise be constructed from a suitable shape memory alloy and/or shaped and/or bent in a manner which allows the clip 414 and, more particularly, the arms 426 and 428 thereof to bend or flex either towards or away from each other in substantially the same manner as the arms 126 and 128 of clip 114 for the same purposes and to accomplish the same results as those accomplished by arms 126 and 128 and thus incorporated herein by reference.

Clip 414 differs in structure from clip 114 in that clip 414 additionally includes a generally rectangularly shaped extension, bracket or lip 435 unitary with and extending outwardly and rearwardly from the outer vertical face 418 of the body 424 thereof.

Clip member 414 is adapted to be wrapped and enveloped within the interior of a padded "U" or "horseshoe" shaped sleeve 409 corresponding in configuration and shape to the clip 414. As such, sleeve 409 and thus the clip support member 400 defines an open ring defining a central base or body segment or portion 470 and a pair of horizontally co-planarly aligned waist and/or hip engaging sleeve arms 472 and 474. Sleeve 409 may be made from the same types of material as the sleeves 109 and 111 of pack 102. Sleeve 409 is contoured so as to define a pair of opposed inclined outer surfaces 494 and 496 extending angularly upwardly from the base of sleeve 409 towards each other and terminating in an upper, elongate arcuate edge 497.

Sleeve 409 includes an elongate tongue 476 which has one end (not shown) stitched or otherwise suitably secured to the underside of the sleeve 409 in the region of the body 470 thereof and an opposed end 478 adapted to be removably secured to the top of the sleeve 409 in the region of the body 470 thereof after the tongue 476 has been wrapped around the handle 480 of the golf bag 402 as shown in FIGS. 14 and 15. Although not shown, it is understood that Velcro® or the like type material may be used and associated with the tongue 476 and the sleeve 409 respectively for allowing the detachable securement of the tongue 476 to the sleeve 409 and thus the detachable securement of the clip member 400 to the handle 480 of the golf bag 402.

As shown in FIGS. 13-15, tongue 476 secures the clip member 400 to the handle 480 and thus to the bag 402. More particularly, tongue 476 is adapted to be fed through the opening 482 defined between the handle 480 and the outer surface 484 of the bag 402 and then wrapped around back over the top of the handle 480 and secured to the top of the sleeve 409.

Straps 486 and 488 associated with bag 402 are secured thereon as known in the art and allow the bag 402 to be suspended and carried from the shoulders of an individual in the over-the-back generally horizontal orientation of FIGS. 17 and 18 where the outer surface of the bag 402 is positioned in abutting relationship against the lower back and upper buttocks of the individual carrying the bag.

Clip member 400 is rotatable in a clockwise direction about the handle 480 and the outer surface 484 of bag 402 from a first position as shown in FIGS. 13 and 17 where the arms 472 and 474 of the clip member 400 extend downwardly away from the handle 480 and are seated generally against and follow the arcuate contour of the outer surface 484 of the bag 402. Clip member 400 is rotatable into the second position shown in FIGS. 14, 15 and 18 where the arms 472 and 474 have been rotated away from the surface 484 approximately forty-five degrees in the clockwise direction into a tangent, outward position relative to the outer surface 484 of the bag 402 thus allowing the lower torso of the individual to be fitted through the opening in the ring defined by said sleeve 409 and thus allowing the clip member 400 to be wrapped into engagement against respective sides of the waist and small of the back of the individual carrying the golf bag 402 as shown in FIG. 18 where the arms 472 and 474 are positioned and engaged against opposed respective sides of the waist and/or hips of the individual and the body portion 470 is engaged against the small of the back of individual.

Still further, and although not shown, it is understood that inclined surface 494 on sleeve 409 is adapted to abut against and follow the contour of the lower back region of the individual carrying the bag thus providing a comfortable, form-fit extending along the waist and back of the individual.

As shown in FIG. 15, the lip 435 on clip 414 is adapted to protrude through an opening (not shown) defined in the back of the sleeve 409 and thereafter extend through the opening 482 defined by handle 480 and into contact with the outer surface 484 of the bag 402 when the clip member 400 is rotated. Lip 435 thus acts as a stop which limits the clip member's rotation to no more than the preferred approximate forty-five degrees. Rotation beyond the preferred forty-five degrees is also prevented as a result of the use of straps 490 (only one of which is visible in FIG. 15) extending between the outer surface 484 of the bag 480 and the distal end of each of the respective sleeve arms 472 and 474.

In a manner similar to that described earlier in connection with the back pack embodiment 102 and thus incorporated by reference, clip member 400 is adapted to advantageously transfer and redistribute the weight of the bag and the clubs housed therein from the shoulders and the upper back of the wearer to the waist, back and hips of the individual. This, of course, is accomplished by allowing the clip member 400, rather than the shoulder straps 497, 498 and 499, to support the weight of the bag and its contents. FIG. 17 shows the bag 402 supported by the straps and shoulders of the individual. Thus, straps 498 and 499 are shown in their "taunt" state. FIG. 18, on the other hand, shows the bag 402 supported by the clip member 400 and the waist, hips and small of the back of the individual and thus straps 498 and 499 are shown in their "loose fitting" state.

This weight transfer, of course, advantageously reduces the burden which is ordinarily associated with carrying a golf bag during an average eighteen hole round of golf. The clip member 400 offers a particular significant advantage for caddies who are commissioned or hired to carry the bags of professional golfers at tournaments and the like where the bags can end up weighing more than fifty pounds.

Clip member 400 offers the additional advantage of moving the bag 402 away from the back and buttocks of the individual as shown in FIG. 18 when the clip member 400 is in its extended engaged relationship against the waist and/or hips of the user thus creating a space between the bag 402 and the carrier which naturally allows the bag 402 to be carried more comfortably and eliminating rubbing between the bag and the individual's body.

Figure 19:
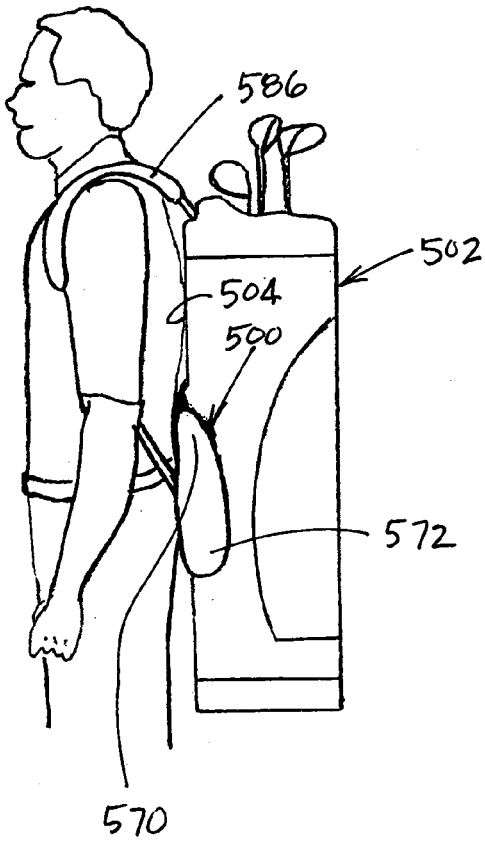
FIGS. 19 and 20 depict a golf bag incorporating an alternate embodiment of the waist clip support member of FIGS. 13 and 14 and suspended from the shoulders of a golfer in a generally vertical orientation and depicting the clip support member in its disengaged and engaged positions respectively.
Figure 20:
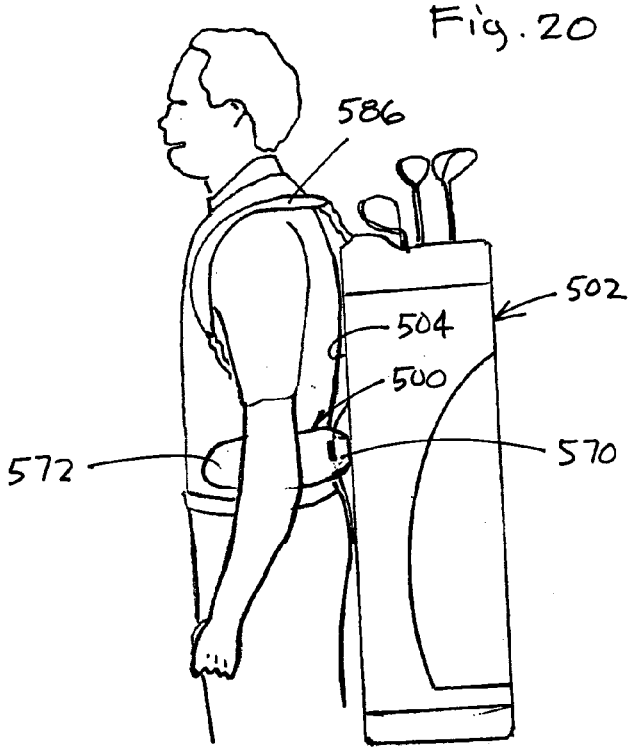

FIGS. 19 and 20 depict a clip member 500 defining an open ring-like structure similar in structure to clip member 400 (the description of which is thus incorporated herein by reference) and adapted for use on a golf bag 502 configured to be carried in a generally vertical over-the-back orientation. Golf bag 502 incorporates a front panel 504 and clip member 500 is mounted thereto by any suitable means such as, for example, a bracket or the like for rotation relative to the front panel 504 between the disengaged position of FIG. 19 where the arms 572 (only one of which is shown in FIGS. 19 and 20) of clip member 500 hang down and are positioned generally adjacent and parallel to the front panel 504 and the engaged position of FIG. 20 where the arms 572 and 574 have been rotated approximately ninety degrees clockwise into a generally normal relationship relative to the front face 504 of bag 502.

In the position of FIG. 20, clip member 500 is positioned in an engaged relationship such that the arms 572 and 574 thereof are positioned against the respective sides of the waist and/or hips of the individual and the central body 570 is positioned against and follows the contour of the small of the back of the individual. The clip member 500, being similar in structure to both the clip member 400 and clip member 100, provides the same weight transfer characteristics as the earlier described clip members and thus the description and discussion of such features and advantages is incorporated herein by reference. As such, clip member 500 advantageously redistributes the weight of the bag and the contents thereof from the shoulder straps 586 (only one of which is shown in FIGS. 19 and 20) thereof and thus the shoulders of the individual (as shown in FIG. 19 which depicts straps 586 in their "taut" state supporting all of the weight of the bag with the clip member 500 in its disengaged orientation) to the clip member 500 and the waist and/or hips and small of the back of the individual (as shown in FIG. 20 which depicts straps 586 in their "loose state" following engagement of the arms of the clip member 500 with the respective sides of the waist and/or hips of the individual).

FIGS. 21-24 depict another clip support member 600 which, in the embodiment shown, is adapted for use in connection with a golf bag 602 adapted to be carried and suspended from the shoulders of an individual in an over-the-back generally horizontal orientation. Clip support member 600 includes a frame or clip 614 and an outer padded sleeve or cushion 609 which surrounds and envelopes the clip 614.

Clip 614 defines an interior skeleton or frame for the support member 600 in the form of a continuous elongate bar or rod of material similar in structure and composition to the material comprising the earlier described clip embodiments which has been bent and shaped so as to define and form an upper top, generally arcuately "U" shaped clip or frame portion 615, a pair of arms 626 and 628 extending unitarily outwardly and downwardly from the opposed ends of the upper clip or frame portion 615 and a generally arcuately "U" shaped lower clip or frame portion 624 which extends between the respective ends of the arms 626 and 628. The clip or frame portion 615 is spaced from the lower clip frame portion 624 in both the lateral (side-to-side) and up and down directions. Lower clip or frame portion 624 has been shaped and bent so as to define a generally arcuate or "U" shaped concave notch 632 located between the arms 626 and 628 and extending rearwardly in the direction of the upper clip frame portion 615.

Clip 614 additionally includes a bracket or plate 634 extending generally upwardly from the back face of the upper clip portion 615. Bracket 634 is centrally located on clip portion 615.

As shown in FIG. 21, sleeve 609 corresponds in shape and configuration to the clip 614 and thus defines a generally "U" shaped clip member 600 including a central generally arcuate body 640 and a pair of side arms 642 and 644 together defining an arcuate generally "U" shaped notch 646 in the front of the clip member 600 adapted to receive and fit the lower torso of the individual carrying the bag 602. Sleeve 609 defines a circumferential lower edge 648 and an upper edge 650 which follows the contour of the clip member 600. Sleeve 609 additionally defines a pair of outer faces 652 and 654 extending generally upwardly and inwardly from the front and rear portions of the circumferential edge 648 respectively and both terminating in the upper edge 650.

Clip member 600 additionally comprises a pair of spaced-apart straps 654 and 656 extending outwardly from the back face of the body 640 of sleeve 609. Still further, the underside of clip member 600 and thus the underside of the sleeve 609 thereof includes a recessed back longitudinal edge 658 defining a generally arcuate, concave surface 660 extending along the length of the back of the sleeve 609.

Figure 23:
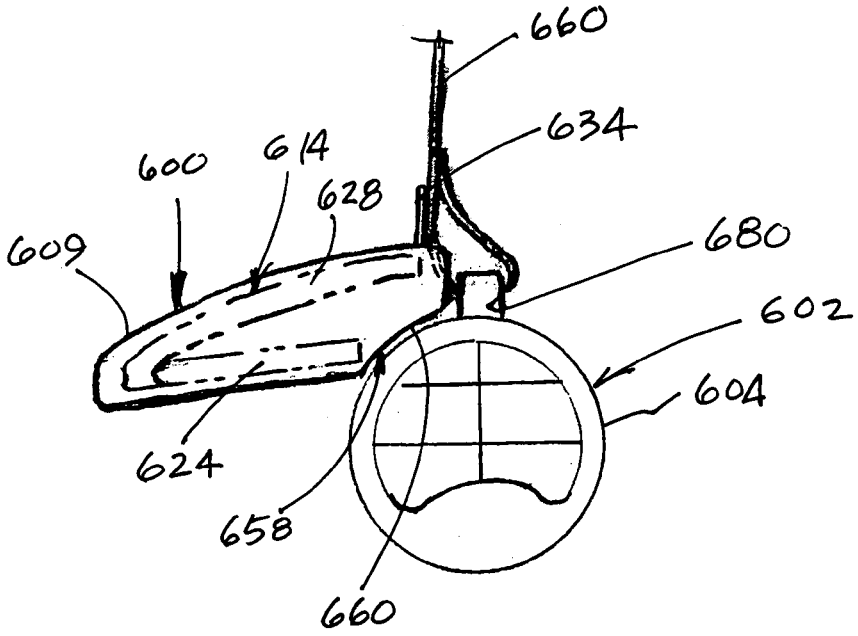
FIG. 23 is a side elevational view of the golf bag of FIG. 21.
Figure 24:
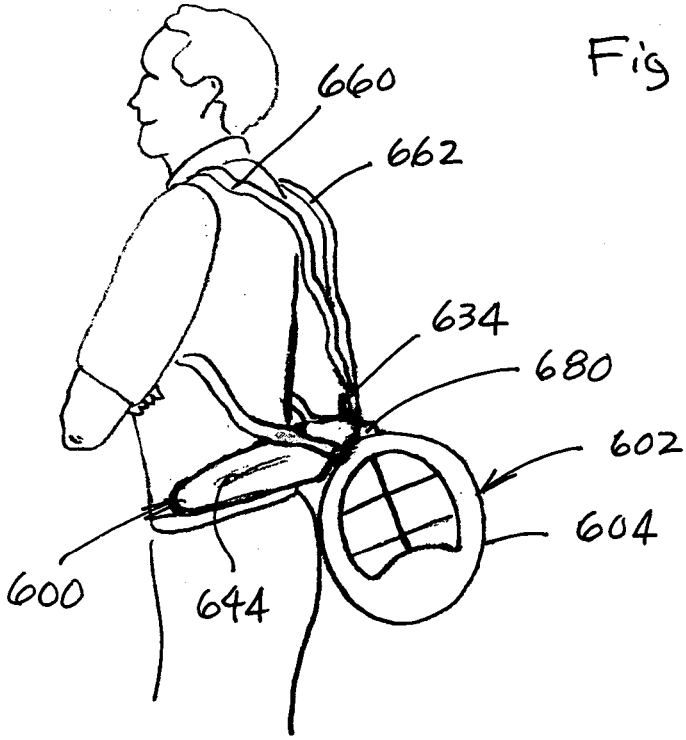
FIG. 24 is a side elevational view depicting the golf bag of FIG. 21 suspended in an over-the-back generally horizontal orientation from the shoulders of an individual with the clip support member in its engaged position against the waist and hips of the individual.

In accordance with the present invention and as shown in FIGS. 23 and 24, clip member 600 is adapted to be detachably secured to and extend outwardly from the handle 680 of golf bag 602. Bag 602 includes a shell defining an outer surface 604 and further includes shoulder straps 660 and 662 adapted to allow the bag 602 to be suspended from the shoulders of an individual and carried in a generally horizontal over-the-back orientation.

As shown in FIG. 21, straps 654 and 656 are adapted to surround and secure the clip member 600 to the handle 680 of the bag 602 in a non-rotatable relationship relative to the handle 680 and bag 602 wherein clip member 600 and, more particularly, the arms 642 and 644 thereof extend and protrude generally outwardly tangentially away from the outer surface 604 of the bag 602 in a direction generally transverse and normal to the longitudinal axis of the bag 604. In this relationship, the concave back edge 658 of the sleeve 609 is seated on, abuts, and follows the contour of the outer surface 604 and the bag 602. In accordance with the present invention, the interior concave arc of edge 658 matches the arc of the outer surface 604 of the bag 602 so as to allow the clip member 600 to protrude outwardly from the bag 602 at approximately a ninety degree angle relative to the bag longitudinal axis.

Moreover, and as shown in FIG. 23, the spacing and relationship between the upper and lower unitary clip or frame portions 615 and 624 of clip 614 respectively is such that upper clip portion 615 is positioned adjacent the handle 680 and extends longitudinally along a top portion of the outer surface of bag 602 while the lower clip or frame portion 624 is positioned below the handle 680 and extends longitudinally along a lower side portion of the outer surface of bag 602. As such, lower clip or frame portion 624 defines a back or rest stop adapted to keep the member 600 in its generally normal extended relationship away from the surface of the bag 602.

As shown in FIG. 24, the lower torso of the individual is adapted to be fitted into the notch defined by sleeve 609 and clip member 600 is adapted to engage the small of the back and the waist and/or hips of the individual carrying the bag in a relationship wherein the arms 642 and 644 thereof are positioned in abutting engaged relationship against the respective sides of the waist and/or hips of the individual. Moreover, and although not shown, it is understood that, in the position of FIG. 24, the small of the back of the individual is located in the notch 646 of the clip member 600 and in abutting relationship with the lower front circumferential edge 648 and inclined face 654 of sleeve 609 to provide a comfortable, custom fit.

Moreover, and as shown in FIGS. 21 and 23, clip member 600 is fixed to the handle 680 of golf bag 602 in a manner wherein bracket 634 abuts against a portion of the shoulder strap 660 extending upwardly between the handle 680 and the shoulders of the individual. In accordance with the present invention, bracket 634, in combination with the strap 660 prevents the clip member 600 from any further upward clockwise rotation or pivoting relative to the bag outer surface 604 thus assuring that the clip member 600 remains against the waist and/or hips of the individual.

Clip member 600, being adapted to engage against the waist and/or hips and the small of the back of an individual, provides the same weight transfer characteristics as the earlier described clip member embodiments, and thus the earlier descriptions of such characteristics and advantages are incorporated herein by reference. It is further understood that clip member 600 may be substituted for the clip member 500 shown in FIGS. 19 and 20 and used on a golf bag adapted to be carried in a generally vertical orientation such as the golf bag 502 shown in FIGS. 19 and 20. It is understood, of course, that unlike the clip member 500, clip member 600 would not be rotatable about the front face of the bag but instead would be fixed, using a bracket or the like securing means known in the art, to the front face of the bag in a generally normal outward position and orientation relative to the front face of the bag similar to that shown in FIG. 20 with respect to clip member 500.

It will be readily apparent from the foregoing detailed description of the invention and from the illustrations thereof that numerous variations and modifications may be effected without departing from the true spirit and scope of the novel concepts or principles of this invention. It will also be readily apparent that the various clip support member embodiments described herein are applicable and intended for use not only with back packs and golf bags but also with a variety of other articles which are adapted to be suspended from the shoulders of an individual in an over-the-back relationship such as, for example, back packs used by military personnel, back mounted vacuum cleaners, back mounted leaf blowers, and baby carriers.

I claim:

1. A pack intended to be carried by a user in an over-the-back relationship, the pack defining an interior shell comprised of a generally vertical front panel adapted to rest against the back of the user, a closed bottom panel defining an interior surface, a pair of opposed side panels, and a back panel, the pack including a clip being defined by a generally U-shaped continuous strip of material extending along the bottom panel of the pack in a generally horizontal relationship and being defined by a generally arcuate and elongate central body which extends through the interior shell and a pair of rigid spaced-apart arms extending outwardly from opposed ends of the central body and protruding through respective openings defined in the front panel of the pack in a relationship and direction generally normal to the front panel of the pack and adapted to rest or engage against the waist and/or hips of the user wherein the arms are adapted to be flexed laterally away from each other for adjusting the width of said clip, said arms being further adapted to spring back towards each other and exert a compressive force against the waist and/or hips of the user.

2. A pack intended to store and carry articles and adapted to be carried by a user in an over-the-back relationship, the pack including a clip comprising an elongate continuous strip of material which has been bent and shaped to define an elongate central body and a pair of rigid spaced-apart arms extending outwardly from opposed ends of the central body and adapted to rest or engage against the waist and/or hips of the user, the pack defining a shell, a generally vertical front panel and a generally horizontal closed bottom panel and generally vertical opposed side panels defining respective interior faces, and an interior, the clip being located within the interior of the pack in a relationship wherein the central body extends through the interior of the rack from a point adjacent the interior face of one of the side panels to a point adjacent the interior face of the other of the side panels and in a generally horizontal relationship along the bottom panel of the pack and the arms protrude from opposed ends of the central body in a generally horizontal relationship from within the interior of the pack through openings defined in the pack in a direction generally normal to the generally vertical front panel, the pack further defining a pair of sleeves extending outwardly from said openings defined in the shell and the arms of said clip being adapted to extend through said sleeves respectively.

3. The clip of claim 1 wherein the arms are adapted to exert a compressive force against the waist and/or hips of the user.

4. A pack adapted to be carried by a user and adapted to carry articles and comprising:

a shell defining an interior adapted to receive and store the articles, the interior being defined by a front panel including an outer surface, a back panel, a bottom panel, a pair of opposed side panels, and a longitudinal axis extending through the shell and the bottom panel in a direction and orientation normal to the bottom panel;

a support member including a central base and a pair of spaced-apart arms which together form a single unitary piece, the central base being located and extending within the interior of the pack in a generally horizontal relationship and direction generally normal to both the longitudinal axis of the shell and the opposed side panels, the spaced-apart arms extending from within the interior of the pack through apertures defined in said pack in a generally horizontal relationship and in a direction generally normal to the longitudinal axis of said shell, said arms being adapted to abut the waist and/or hips of the user; and a pair of sleeves in communication with said apertures defined in the outer surface of said pack and extending outwardly from said outer surface of said pack in a direction and relationship generally normal to the longitudinal axis of said shell, said arms of said support member extending through said sleeves.

5. The pack of claim 4 wherein said central base extends through the interior of the pack from a point adjacent one of the opposed side panels to a point adjacent the other of the opposed side panels and extends in a generally horizontal relationship along the bottom panel of the pack, said arms extending unitarily outwardly from opposed ends of said base and being adapted to flex towards and away from each other.

6. The pack of claim 4 further including a strap associated with said support member and extending between and interconnecting said arms, said strap being located between the pack and the back of the user and the arms being adapted for pivotal movement towards each other in response to a rearward lateral movement of said strap when said pack is mounted over the back of the user and said strap comes into abutting relationship with the back of the user.

* * * * *